United States Patent [19]

Glassmeyer

[11] 4,151,925

[45] May 1, 1979

[54] FLATRACK CONTAINER

[75] Inventor: John J. Glassmeyer, Glenwood, Ill.

[73] Assignee: Pullman Incorporated, Chicago, Ill.

[21] Appl. No.: 890,776

[22] Filed: Mar. 27, 1978

[51] Int. Cl.[2] ..... B65G 1/20

[52] U.S. Cl. ..... 220/1.5; 211/208; 248/354 S; 206/386

[58] Field of Search ..... 220/1.5; 206/386; 248/16, 119 R, 354 S; 211/190, 207, 208

[56] References Cited

U.S. PATENT DOCUMENTS

| | | | |
|---|---|---|---|
| 3,386,600 | 6/1968 | Betjemann | 220/1.5 |
| 3,459,326 | 8/1969 | Betjemann | 220/1.5 |
| 3,620,388 | 11/1971 | Mansson | 220/1.5 |
| 3,651,974 | 3/1972 | Barry et al. | 220/1.5 |
| 3,742,662 | 7/1973 | Ballou | 248/354 S |
| 3,765,556 | 10/1973 | Baer | 220/1.5 |
| 3,807,581 | 4/1974 | Nichols | 220/1.5 |

*Primary Examiner*—William Price
*Assistant Examiner*—Joseph M. Moy
*Attorney, Agent, or Firm*—Thomas G. Anderson

[57] ABSTRACT

A flatrack container for container loads has a pair of bulkhead assemblies at either end of a load platform, with each of the bulkhead assemblies including a telescoping assembly carrying stacking and lifting fittings being vertically adjustable so that the fittings can be positioned at any desired vertical position. One of the bulkhead assemblies is pivotally mounted so that it may be swung to the ground to serve as a drive-on ramp to aid in loading the container.

10 Claims, 8 Drawing Figures

FLATRACK CONTAINER

BACKGROUND OF THE INVENTION

1. Field of the Invention

The present invention relates to shipping containers in general, and in particular to freestanding containers capable of carrying rolling or non-rolling containerized cargo and mountable on a variety of carrying vehicles.

2. Description of the Prior Art

The prior art, as exemplified by U.S. Pat. No. 3,459,326, is generally cognizant of shipping containers having upper corner fittings which may be adjusted in their vertical position. The prior art also includes examples, such as that shown in U.S. Pat. No. 3,620,388, of containers having end structures pivotable for form loading ramps. Other shipping containers are shown in U.S. Pat. Nos. 1,740,000, 3,244,310 and 3,807,581.

SUMMARY OF THE INVENTION

The present invention is summarized in that a flatrack container includes a generally horizontal load platform for receiving a load thereon, a generally vertical bulkhead assembly upstanding from each end of the load platform, a pair of hollow corner posts at each side of each of the bulkhead assemblies, an elevating mechanism mounted in each of the bulkhead assemblies, a vertical threaded rod extending upward from each of the elevating mechanisms, a crank handle attached to each of the elevating mechanisms, a telescoping assembly received in each of the bulkhead assemblies, each telescoping assembly including a center post depending from the center thereof and a pair of telescoping corner posts each received within a one of the corner posts of the respective bulkhead assembly, a threaded fitting secured inside the center posts and threaded on the threaded post so that operation of the elevating mechanism by the crank handle adjusts the vertical position of the telescoping assembly, a pair of upper corner fittings on each telescoping assembly provided with apertures for use in lifting the container, and locking means to lock the telescoping assembly in the vertical position to which it is adjusted.

It is an object of the present invention to provide a flatrack container in which the upper corner fittings on each end thereof may be mechanically and easily adjusted in their vertical position.

It is another object of the present invention to construct such a container in which one of the bulkhead assemblies at one end thereof is pivotable so that load carrying vehicles may be driven directly onto the container.

It is yet another object of the present invention to provide such a pivotable bulkhead assembly that includes self-supporting ramps to aid in the loading of the container by vehicles.

Other objects, advantages and features of the present invention will become apparent from the following description when taken in conjunction with the accompanying drawings.

DESCRIPTION OF THE PREFERRED EMBODIMENT

Figures 1, 2:
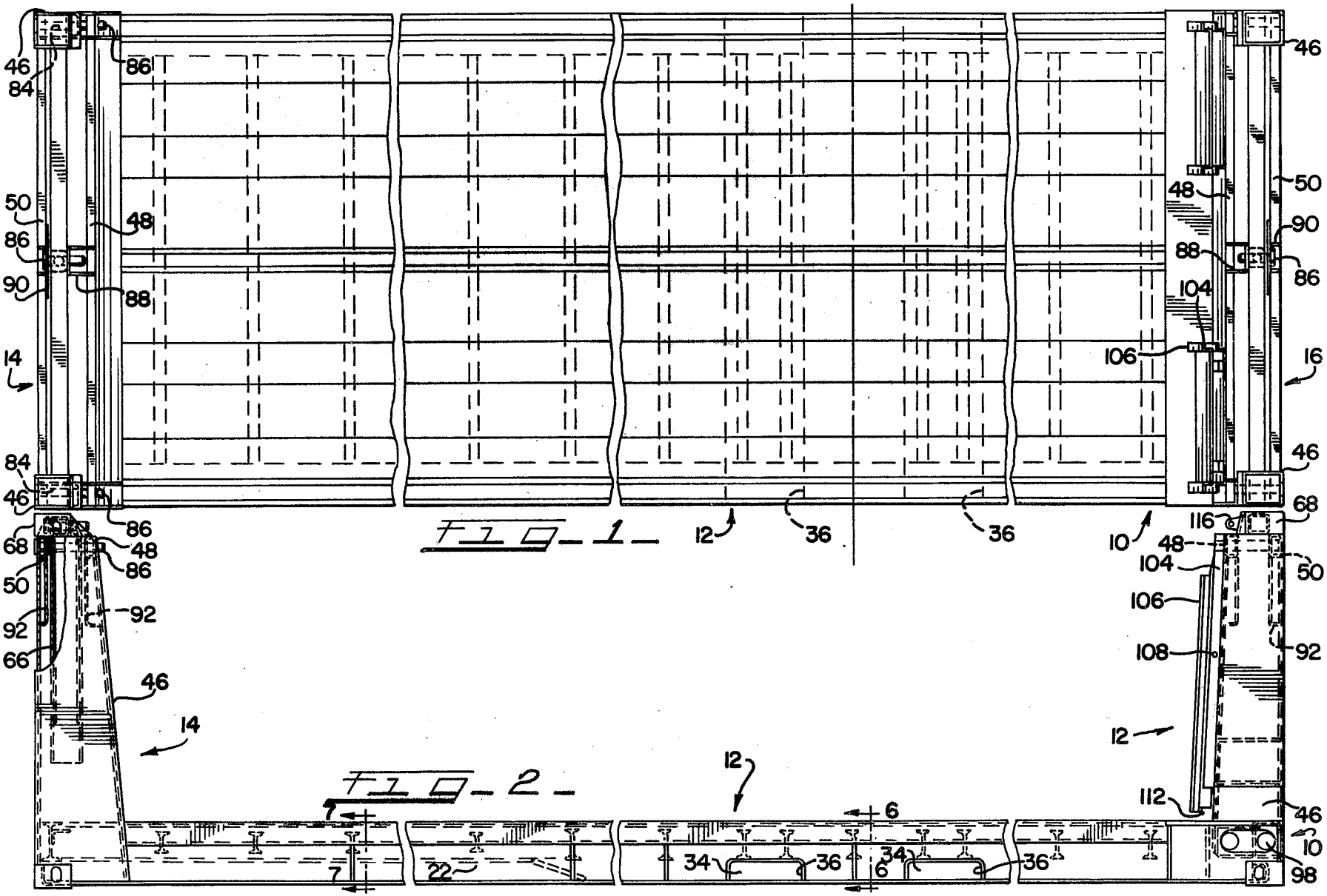
FIG. 1 is a top plan view of a flatrack container constructed according to the present invention.
FIG. 2 is a side elevation view of FIG. 1.

As is shown in FIGS. 1 and 2 the present invention is embodied in a variable height flatrack container, indicated generally at 10. The flatrack container 10 includes a horizontal load platform, indicated generally at 12, from which there extends vertically a front bulkhead assembly, indicated generally at 14, and a rear bulkhead assembly, indicated generally at 16.

Figure 6:
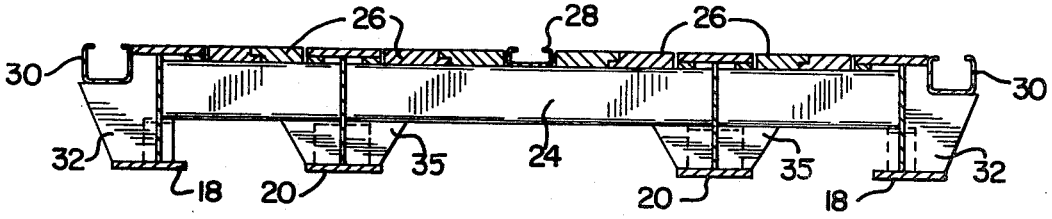
FIG. 6 is a cross-section view taken along the line 6—6 in FIG. 2.
Figure 7:
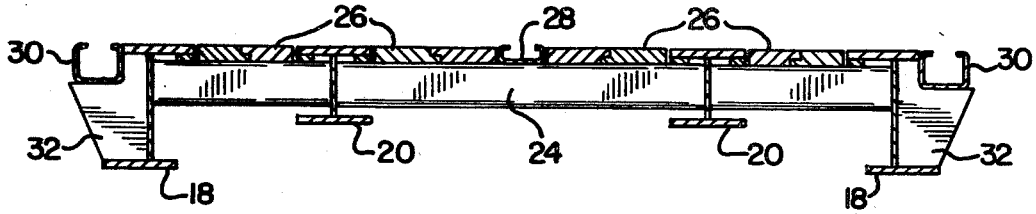
FIG. 7 is a cross-section view taken along the line 7—7 in FIG. 2.

The load platform 12 is formed on four longitudinally extending I-beams, a pair of outer I-beams 18 and a pair of inner I-beams 20, as can be seen in FIGS. 6 and 7. The two outer I-beams 18 are generally constant in vertical depth while the two inner beams 20 have a tapered region formed toward the front end of the flatrack container to better mate with a carrying assembly. A series of cross-beams 24 are positioned stretching laterally between each of the I-beams 18 and thru I-beams 20 with the cross-beams 24 being longitudinally spaced along the entire length of the flatrack container 10. Decking members 26 are secured along the tops of the I-beams 18 and 20 and cross-beams 24 to provide a uniform flat surface for the load platform 12. A center U-shaped channel 28 is provided extending along the longitudinal centerline of the load platform 12 while a pair of deeper U-shaped outer guide channels 30 are provided along the outer lateral edges of the load platform 12 just outside of the outer I-beams 18. A series of support gussets 32 are provided extending between the outer I-beams 18 and the outer guide channels 30 and are positioned adjacent every other one of the cross-beams 24. Another series of gussets 35 are formed at longitudinally spaced points spanning between the inner I-beams 20 and the cross beams 24. A pair of fork pockets 34 are formed by a pair of laterally aligned openings formed in each of the I-beams 18 and 20 and a fork pocket sleeve 36 is secured to the I-beams 18 and 20 to line the fork pocket 34 along its entire lateral extent.

Figure 3:
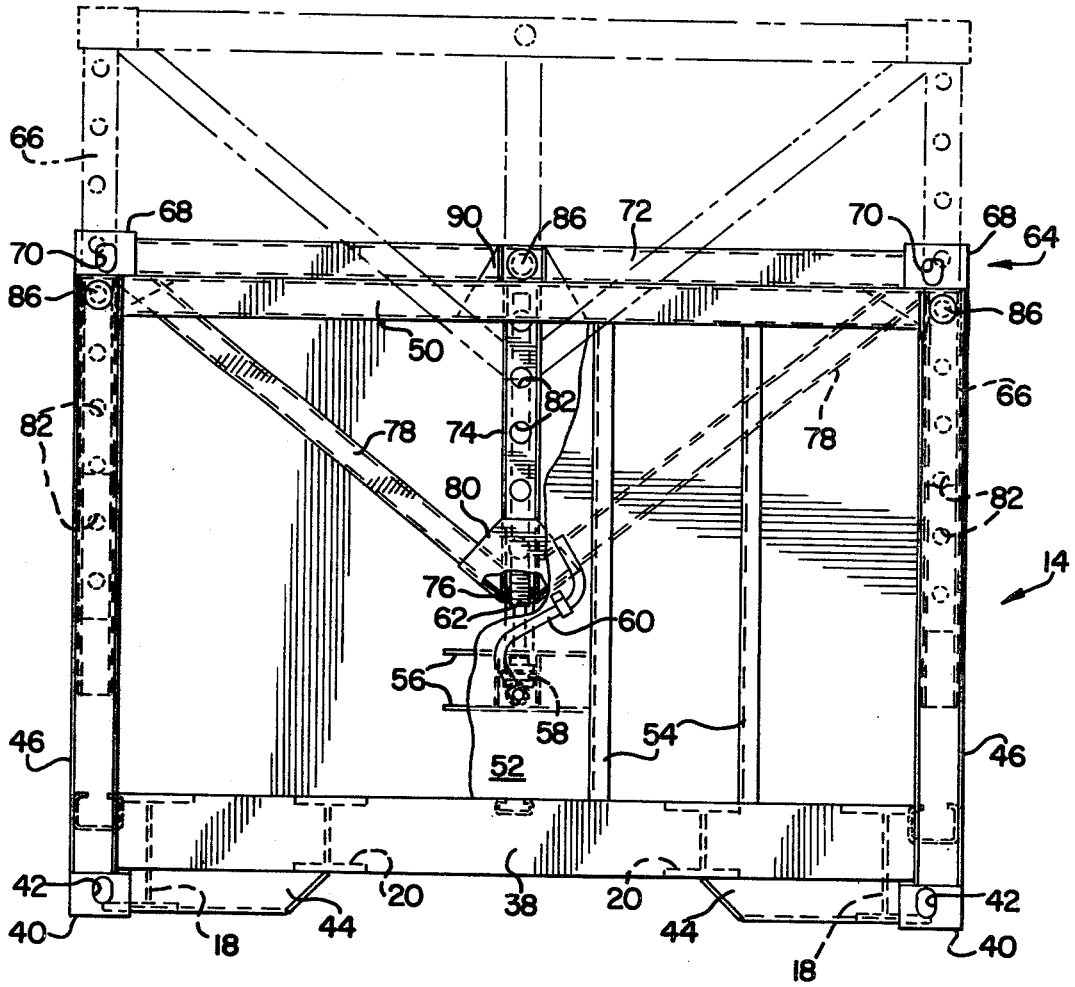
FIG. 3 is a front elevation view of FIG. 1.

At the front end of the load platform 12 forming the base for the front bulkhead assembly 14 is a front end crossbeam 38 which stretches across the ends of the respective I-beams 18 and 20, as can be seen in FIG. 3. Mounted beneath the extreme ends of the front end crossbeam 38 are a pair of lower corner fittings 40 each of which has securement apertures 42 for use in tying down the container and each of which is reinforced in its position by a gusset 44 secured to the front end crossbeam 38 and the outer and inner I-beams 18 and 20.

The front bulkhead assembly 14 includes, as can be seen from FIGS. 2 and 3, a pair of upright corner posts 46 formed at each side thereof and secured at their lower ends to the front end crossbeam 38, the outer I-beams 18 and the outer guide channels 30 with the lower corner fittings 40 being attached to the lower front edge thereof. The corner posts 46 are vertically extending hollow members having a generally rectangular cross section which decreases in size in an upward direction inasmuch as the inner surfaces of the corner posts 46 are slanted slightly off of true vertical to taper the corner posts 46 toward their upper ends. Extending between the ends of the two corner posts 46 are inner and outer front end headers 48 and 50 secured to the inside of the inner transverse surfaces of the corner posts 46. Each of the headers 48 and 50 is formed as a tubular member of a generally rectangular shape. The area of the front bulkhead assembly 14 bounded by the corner posts 46, the outer front end header 50 and the front end crossbeam 38 is spanned by a front end sheet 52. A series of four stiffeners 54 formed of angle irons are secured to the sheet 52 and extend between the outer front end header 50 and the front end crossbeam 38. Mounted on the interior of the sheet 52 along the vertical centerline of the front bulkhead assembly 14 are a pair of support plates 56 which secure in place an elevating mechanism 58 to which is attached a crank handle 60 mounted on the outer side of the sheet 52. Extending vertically upward from the elevating mechanism 58 along the inner side of the sheet 52 is a threaded shaft 62.

Received within the front bulkhead assembly 14 is a front telescoping assembly, indicated generally at 64. The telescoping assembly 64 is defined at its sides by a pair of telescoping corner posts 66 each of which is received within a respective one of the corner posts 46. Each of the telescoping corner posts 66 is topped by an upper corner fitting 68. The two upper corner fittings 68 are joined by an elongated tubular header 72 of a generally rounded rectangular cross-section. A center post 74 extends vertically downward from the center of the header 72 and has fixed in its lower end a threaded fitting 76 which is threaded onto the threaded shaft 62. A pair of support braces 78 connect the lower end of the center post 74 with the junction of the header 72 with each of the telescoping corner posts 66, and a support plate 80 is welded to the lower end of the center post 74 and the support braces 78 to further strengthen the assembly.

Each of the telescoping corner posts 66 of the telescoping assembly 64 has formed in it a series of vertically spaced holes 82 as does the center post 74. At the junction of each of the corner posts 46 with the front end headers 48 and 50 bores 84 are provided extending completely through the front end headers 48 and 50 with the bores 84 being filled by a pair of peg members 86. A similar bore 84 is provided in each of a pair of upstanding centerpeg supports 88 and 90 mounted on the center of the front end headers 48 and 50, with another peg member 86 being inserted in the center bore 84 also. A pair of vertical guides 92 are formed inside each of the corner posts 46 depending downward from the front end headers 48 and 50 on either side of the telescoping corner posts 66 as can best be seen in FiG. 2.

Figure 4:
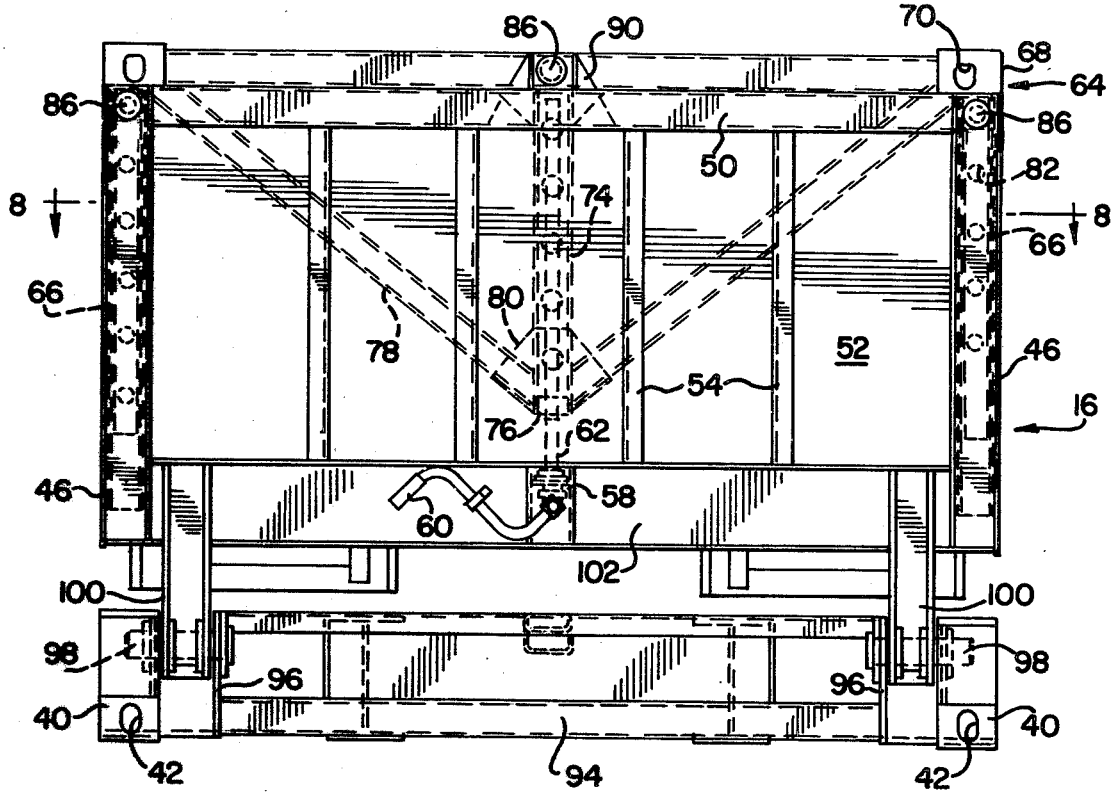
FIg. 4 is a rear elevation view of FIG. 1.
Figure 8:
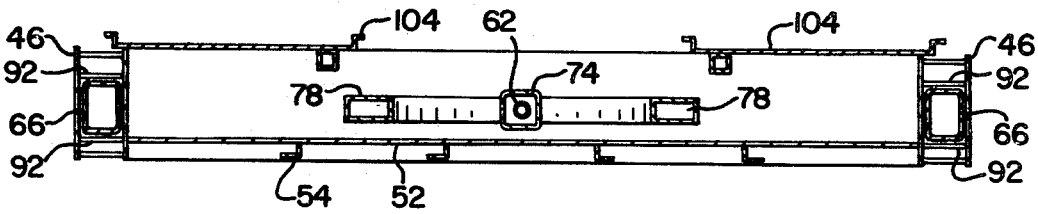
FIG. 8 is a cross-section view taken along the line 8—8 in FIG. 4.

Those parts of the rear bulkhead assembly 16 which are largely identical to their counterparts in the front bulkhead assembly 14 are identified with the same reference numeral as those corresponding parts and those parts that are different have been given new reference numerals. As can be seen in FIG. 4 the rear end of the load platform 12 is terminated by a rear end crossbeam 94 of a smaller height than the front end crossbeam 38. At either end of the rear end of the load platform 12 just inside of lower corner fittings 40 are a pair of pivot pin journal mounts 96 which receive a pair of pivot pins 98 which also extend through elongated openings in the lower ends of a spaced pair of vertical rear bulkhead support beams 100. A lower cross beam 102 secured to the upper ends of both of the support beams 100 forms the base for the rest of the rear bulkhead assembly 16. Most of the remainder of the rear bulkhead assembly 16 is identical to the front bulkhead assembly 14 with the addition of a pair of fixed ramps 104 and movable ramps 106 inside of the rear bulkhead assembly 16. The fixed ramps 104 are permanently mounted on the inside of the rear bulkhead assembly 16 on the corner posts 46 spaced apart the width of conventional vehicle wheels, as can be seen in FIG. 8. The fixed ramps 104 each have a hole 108 formed in them corresponding to a similar hole 110 formed in the movable ramps 106. The movable ramps 106 each have a mounting fitting 112 at their rear ends and a ramp step 114 at their front ends. A ramp support bar 116 is mounted on the interior surface of the tubular header 72 of the rear bulkhead assembly 16.

Figure 5:
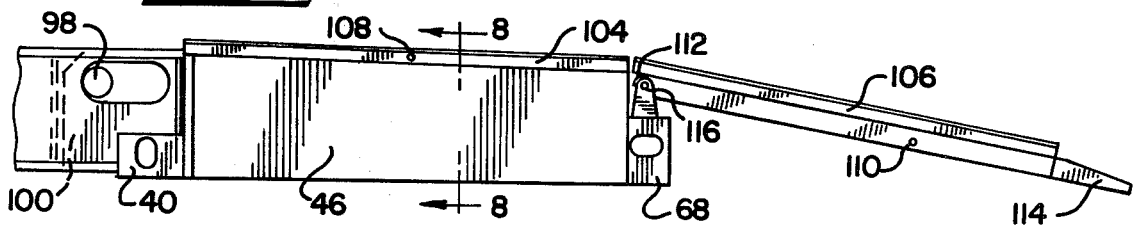
FIG. 5 is a side elevation view of the rear bulkhead assembly of the container of FIG. 1 pivoted to serve as a loading ramp for the container.

In its operation the flatrack container 10 serves to carry loads for shipment, such as vehicles, other rolling equipment or bulk containers. To aid in loading equipment onto the flatrack container 10 the rear bulkhead assembly 16 pivots around the pivot pins 98 from its position shown in FIG. 2 to its position shown in FIG. 5. Once the rear assembly 16 is thus lowered, the movable ramps 106 can be removed from their storage positions nested in their fixed ramps 104 by removal of a securement pin inserted in the holes 108 and 110. The movable ramps 106 are then placed with their ramp steps 114 on the ground and their mounting fittings 112 placed on the ramp support bar 116 as seen in Fig. 5. Vehicles carrying the container loads can then be driven up the ramps 104 and 106 onto the load platform 12 where the loads are deposited. Note that since the openings in the bulkhead support beams 100 which receive the pivot pins 98 are elongated, the rear bulkhead assembly 16 can be pivoted and then moved slightly inward so that the ends of the fixed ramps 104 are even with the load platform 12. The channels 28 and 30 in the load platform 12 serve as guides for the loads. The rear bulkhead assembly 16 can be returned to its vertical position after loading is completed. The flatrack container 10 can be lifted and mounted on a carrying vehicle using a fork lift inserted into the fork lift pockets 34.

The position of the telescoping assembly 64 is adjusted by the elevating mechanism 58. First the peg members 86 are removed and then the crank handle 60 is manually rotated to operate the elevating mechanism 58. Operation of the elevating mechanism 58 causes the threaded shaft 63 to rotate thereby causing the fitting 76 threaded thereon to be moved upward carrying with it the entire telescoping assembly 64. The peg members 86 are reinserted in the closest appropriate ones of the holes 82 in the telescoping corner posts 66 and the center post 74 to fix the telescoping assembly in its desired position during transport.

The provision for the elevating mechanism 58 to raise and lower the telescoping assembly 64 is a significant advantage to the container of the present invention. Since each pair of upper fittings 68 are raised and lowered together they are always even. The mechanical nature of this adjustment makes it easier and faster to accomplish than in prior art constructions. The provisions for the plug members 86 ensures that these fittings are securely locked in place during transit and the fact that there are three of the plug members 86 adds a redundant safety factor.

Inasmuch as the present invention is subject to many variations, modifications and changes in detail, it is intended that all the material in the foregoing description or in the accompanying drawings be interpreted as illustrative and not in a limiting sense.

What is claimed is:

1. A flatrack container comprising
a generally horizontal load platform for receiving a load thereon;
a generally vertical bulkhead assembly upstanding from each end of the load platform;
a pair of hollow corner posts at each side of each of the bulkhead assemblies;
an elevating mechanism mounted in each of the bulkhead assemblies;
a vertical threaded rod extending upward from each of the elevating mechanisms;
a crank handle attached to each of the elevating mechanisms;
a telescoping assembly received in each of the bulkhead assemblies, each telescoping assembly including a center post depending from the center thereof and a pair of telescoping corner posts each received within one of the corner posts of the respective bulkhead assembly;
a threaded fitting secured inside the center post and threaded on the threaded post so that operation of the elevating mechanism by the crank handle adjusts the vertical position of the telescoping assembly;
a pair of upper corner fittings on each telescoping assembly provided with securement holes for use in lifting and stacking the container;
locking means to lock the telescoping assembly in the vertical position to which it is adjusted.

2. A flatrack container as claimed in claim 1, wherein
the telescoping corner posts have a series of vertically spaced holes and the corner posts of the bulkhead assemblies each have a single hole therein and wherein the locking means include a peg member inserted through the hole in each corner post and one of the holes in the respective telescoping corner post to fix the telescoping assembly in position.

3. A flatrack container as claimed in claim 2, wherein
the center post of each telescoping assembly also has a series of vertically spaced holes and a pair of center peg supports are mounted on each of the bulkhead assemblies on either side of the center post, each of the center peg supports having a hole therein and wherein the locking means further includes another peg member inserted through the holes in the center peg supports and through one of the holes in the center post.

4. A flatrack container as claimed in claim 1, wherein
a sheet of metal supported by stiffeners joins the corner posts in each bulkhead assembly and wherein the elevating mechanism in each bulkhead assembly is secured in the sheet.

5. A flatrack container as claimed in claim 1, wherein
a tubular header joins the telescoping corner posts of each telescoping assembly with the center post of each telescoping assembly depending from the tubular header and wherein a pair of support braces in each telescoping assembly stretch between the center post and the telescoping corner posts.

6. A flatrack container as claimed in claim 1, wherein
a rear one of the bulkhead assemblies is pivotally attached to the load platform so that it may be lowered to a horizontal position.

7. A flatrack container as claimed in claim 6, wherein
the rear bulkhead assembly has fixed ramps mounted thereon to allow vehicles to drive across the rear bulkhead assembly when it is lowered on its horizontal position.

8. A flatrack container as claimed in claim 7, further including movable ramps which are nestable inside the fixed ramps and wherein both the fixed and movable ramps have corresponding holes formed therein so the movable ramps can be secured in their nested position.

9. A flatrack container as claimed in claim 7, wherein
a mounting fitting is provided on each of the movable ramps and wherein a ramp support bar is mounted on the rear bulkhead assembly so that the movable ramps can be placed with their mounting fittings on the ramp support bar.

10. A flatrack container as claimed in claim 7, wherein
there are support beams having elongated holes formed in them receiving pivot pins secured to the load platform.

* * * * *